US011527181B2

(12) United States Patent
Cicirelli

(10) Patent No.: US 11,527,181 B2
(45) Date of Patent: Dec. 13, 2022

(54) SYSTEM OF PRODUCING VISUAL EFFECTS

(71) Applicant: David Ralph Cicirelli, Brooklyn, NY (US)

(72) Inventor: David Ralph Cicirelli, Brooklyn, NY (US)

( * ) Notice: Subject to any disclaimer, the term of this patent is extended or adjusted under 35 U.S.C. 154(b) by 126 days.

(21) Appl. No.: 17/249,958

(22) Filed: Mar. 19, 2021

(65) Prior Publication Data

US 2021/0209975 A1 Jul. 8, 2021

Related U.S. Application Data

(63) Continuation-in-part of application No. 16/363,151, filed on Mar. 25, 2019, now abandoned.

(60) Provisional application No. 62/621,647, filed on Jan. 25, 2018.

(51) Int. Cl.

| | |
|---|---|
| ***G09F 13/16*** | (2006.01) |
| ***G09F 13/04*** | (2006.01) |
| ***G09F 13/14*** | (2006.01) |
| ***G09F 19/22*** | (2006.01) |
| ***G09F 13/22*** | (2006.01) |
| ***G09F 13/18*** | (2006.01) |

(52) U.S. Cl.

CPC ..... *G09F 13/16* (2013.01); *G09F 13/0413* (2013.01); *G09F 13/14* (2013.01); *G09F 13/22* (2013.01); *G09F 19/22* (2013.01); *G09F 13/0418* (2021.05); *G09F 2013/142* (2013.01); *G09F 2013/1886* (2013.01)

(58) Field of Classification Search

CPC ..... G09F 13/16; G09F 13/0413; G09F 13/14; G09F 13/22; G09F 19/22; G09F 13/0418; G09F 2013/142; G09F 2013/1886; G09F 19/12; G09F 27/00; G09F 19/18

USPC ..... 472/63

See application file for complete search history.

(56) References Cited

U.S. PATENT DOCUMENTS

| | | | | |
|---|---|---|---|---|
| 3,502,402 | A * | 3/1970 | Markson | G03B 37/00 359/449 |
| 4,640,266 | A * | 2/1987 | Levy | A61M 21/0094 428/912.2 |
| 5,346,433 | A * | 9/1994 | Weinreich | A63J 21/00 472/63 |
| 9,563,115 | B2 * | 2/2017 | O'Connell | G03B 21/2033 |
| 9,919,162 | B2 * | 3/2018 | Knight | A61N 5/06 |
| 9,956,375 | B2 * | 5/2018 | McNew | A61M 21/0094 |
| 2006/0284788 | A1 * | 12/2006 | Robinson | G09F 19/12 345/3.1 |

(Continued)

*Primary Examiner* — Michael D Dennis

(74) *Attorney, Agent, or Firm* — Dunlap Bennett & Ludwig, PLLC

(57) ABSTRACT

A system for simultaneously producing immersive visual effects on an inside of an enclosure and passive visual effects to be viewed from the outside of the enclosure. The enclosure includes a plurality of sidewalls each having a reflective inner surface facing one other. The system includes a digital video display positioned to direct digital video imagery through the semi-reflective sidewall and into the enclosure. Light of the digital video imagery reflects off the reflective inner surfaces of plurality of sidewalls, which allow a percentage of the light to leave the enclosure, making the visual effects observable from the outside. The light will continue this cycle of reflection and transmission, creating an observable infinity effect from the outside, and an entirely enclosed visual experience from the inside.

6 Claims, 5 Drawing Sheets

(56) References Cited

U.S. PATENT DOCUMENTS

| | | | | |
|---|---|---|---|---|
| 2008/0174735 | A1* | 7/2008 | Quach | G03B 21/10 353/15 |
| 2012/0231893 | A1* | 9/2012 | Shimojo | A63G 31/02 472/63 |
| 2019/0318674 | A1* | 10/2019 | Cicirelli | G09F 19/16 |

* cited by examiner

SYSTEM OF PRODUCING VISUAL EFFECTS

CROSS-REFERENCE TO RELATED APPLICATION

This application claims the benefit of priority of U.S. provisional application No. 62/621,647, filed Jan. 25, 2018, and claims the benefit of priority of U.S. Non-provisional application Ser. No. 16/363,151, filed Mar. 25, 2019, the contents of both are herein incorporated by reference.

BACKGROUND OF THE INVENTION

The present invention relates to visual effects and, more particularly, to a system of producing visual effects.

Unique visual effects are desirable. Certain visual effect systems include visible illuminated objects (such as a neon or an LED light) inside a semi-reflective mirror structure. As a result, they are static or simply twinkle with the illuminated object visible. Additionally, these structures are either a room enclosure that one must be inside of in order to experience, or a sculptural enclosure that is passively observed—but not simultaneously both.

Lastly, semi-reflective mirrors are not strong enough to act as room enclosures without going through a strengthening process, which compromises their ability to create smooth reflections.

As can be seen, there is a need for an enhanced system embodied in an enclosure constructed of semi-reflective panels enabling visual effects through kinetic visuals that can be observed inside and outside the enclosure. The enclosure can accommodate observers inside for an immersive experience of the infinity-like visual effects. The semi-reflective panels of the enclosure simultaneously enable observers outside the enclosure to view and experience the kinetic visuals, while also fully concealing the video source from the observers.

The semi-reflective panels are uniquely configured to be structurally sound without compromising the quality of reflections, which can be experienced both sculpturally and experientially. This is achieved by applying processes that create ideal lighting conditions through the brightness of the display, the transmission and reflection rate of the glass, and the tint of the substrate.

The resulting infinity visual effects are made more perfect by an assembly process that allows the structure to be strong enough to act as a room, yet avoids the visual compromises of the tempering process, whereby the "wavy" reflections created by the glass tempering process are disguised to create a more perfect visual effect safe to enter, while still providing a unique passive viewing experience from without.

SUMMARY OF THE INVENTION

In one aspect of the present invention, a system of producing visual effects, the system includes the following: an enclosure comprising a plurality of sidewalls each comprising a reflective inner surface facing one other, wherein at least one of the plurality of sidewalls is a first semi-reflective sidewall; and a second semi-reflective sidewall opposite the first semi-reflective sidewall; each semi-reflective sidewall comprises a tempered glass and an un-tempered substrate laminated to the tempered glass, wherein the un-tempered substrate provides a reflection rate between 30 and 70 percent and a transmission rate between 70 and 30 percent, wherein the un-tempered is the reflective inner surface; and a digital video display positioned to direct digital video imagery through the semi-reflective sidewall and into the enclosure, wherein light of the digital video imagery reflects off the reflective inner surfaces of the plurality of sidewalls.

In another aspect of the present invention, an enclosure for producing visual effects observable from outside and inside of the enclosure, wherein the enclosure is configured to accommodate at least one human being therein, the enclosure including the following: a plurality of sidewalls each comprising a reflective inner surface facing one other, wherein at least two of the plurality of sidewalls is a first semi-reflective sidewall; and a second semi-reflective sidewall opposite the first semi-reflective sidewall; each semi-reflective sidewall comprises a tempered glass and an un-tempered substrate laminated to the tempered glass, wherein the un-tempered substrate provides a reflection rate between 30 and 70 percent and a transmission rate between 70 and 30 percent, wherein the un-tempered is the reflective inner surface, wherein the inner surfaces of the plurality of sidewalls other than the first semi-reflective sidewall and the second semi-reflective sidewall is one of fully reflective and semi-reflective; and a digital video display positioned to direct digital video imagery through the semi-reflective sidewall and into the enclosure, wherein light of the digital video imagery reflects off the reflective inner surfaces of the plurality of sidewalls, wherein the digital video imagery comprises a minimum of 350 nits of brightness at a contrast ratio of 10,000:1 or greater.

These and other features, aspects and advantages of the present invention will become better understood with reference to the following drawings, description and claims. Furthermore, parameters on defining what constitutes a semi-reflective surface, what a video display encompasses, how to achieve optimal lighting balance between the inside and outside of the enclosure, and how to create a structure that maintains a high-quality visual effect while being structurally sound, will all be defined.

DETAILED DESCRIPTION OF THE INVENTION

Figure 1:
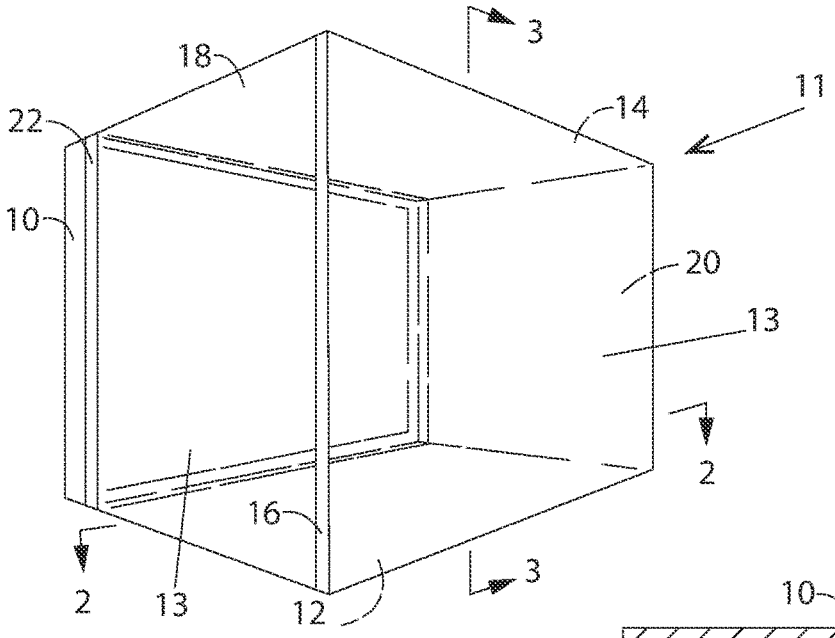
FIG. 1 is a perspective view of an exemplary embodiment of an embodiment of the present invention.
Figure 2:
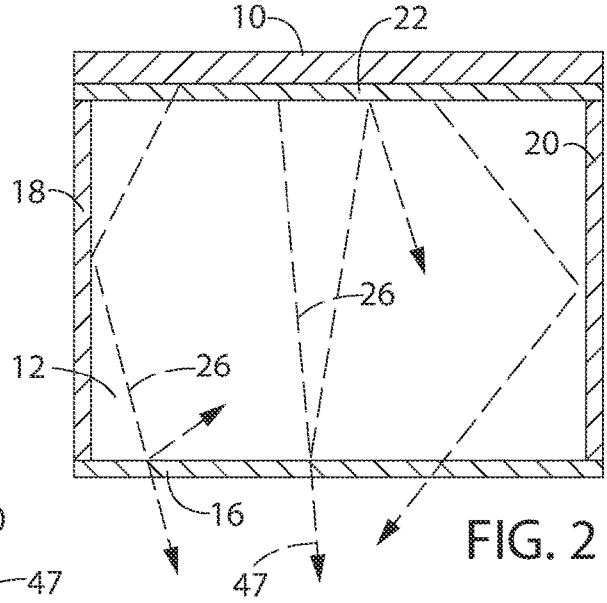
FIG. 2 is a section view of an exemplary embodiment of the present invention, taken along line 2-2 in FIG. 1.
Figure 3:
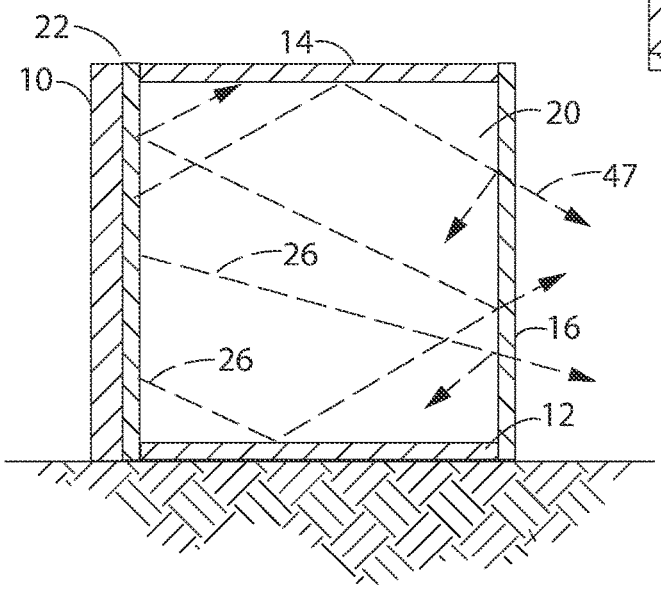
FIG. 3 is a section view of an exemplary embodiment of the present invention, taken along line 3-3 in FIG. 1.
Figure 4:
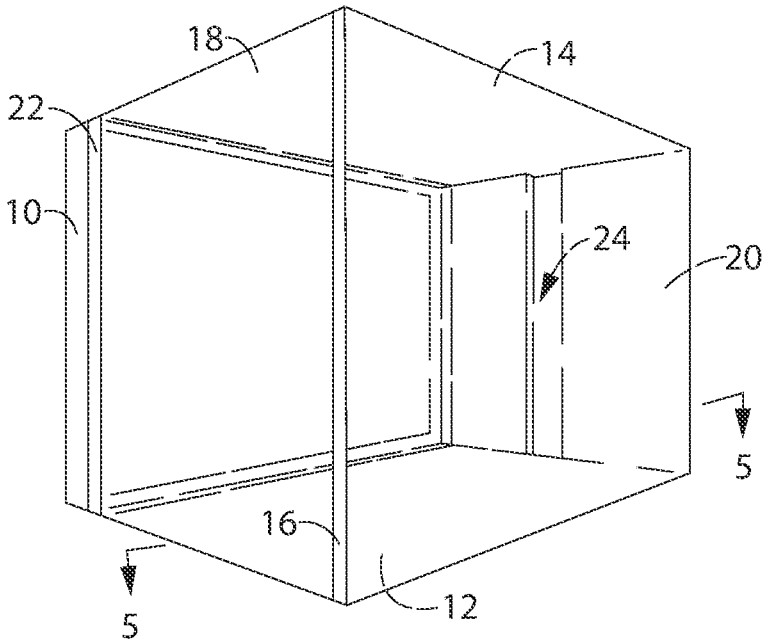
FIG. 4 is a perspective view of an exemplary embodiment of the present invention.
Figure 5:
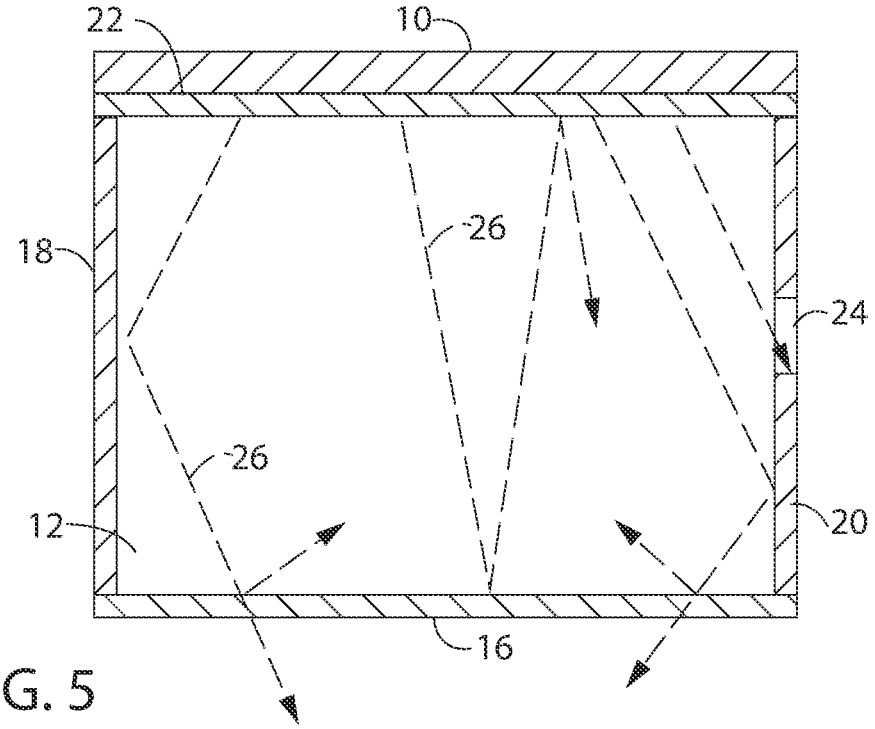
FIG. 5 is a section view of an exemplary embodiment of the present invention, taken along line 5-5 in FIG. 4.
Figure 6:
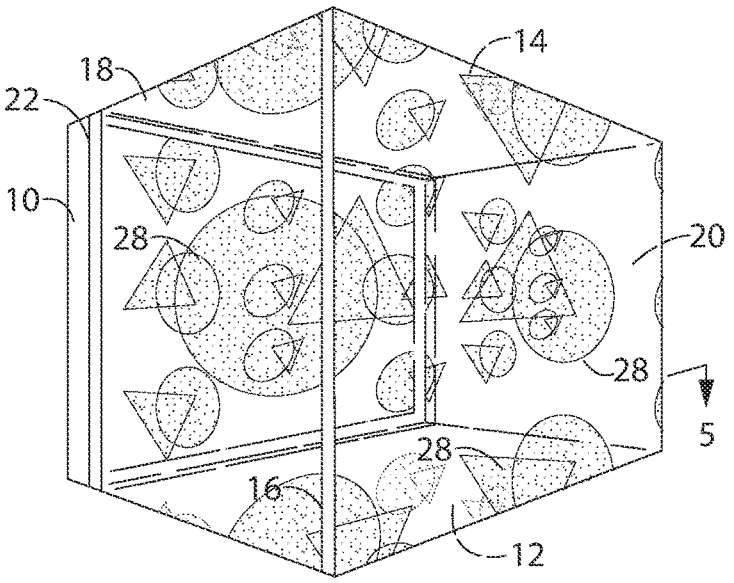
FIG. 6 is a perspective view of an exemplary embodiment of the present invention.
Figure 7:
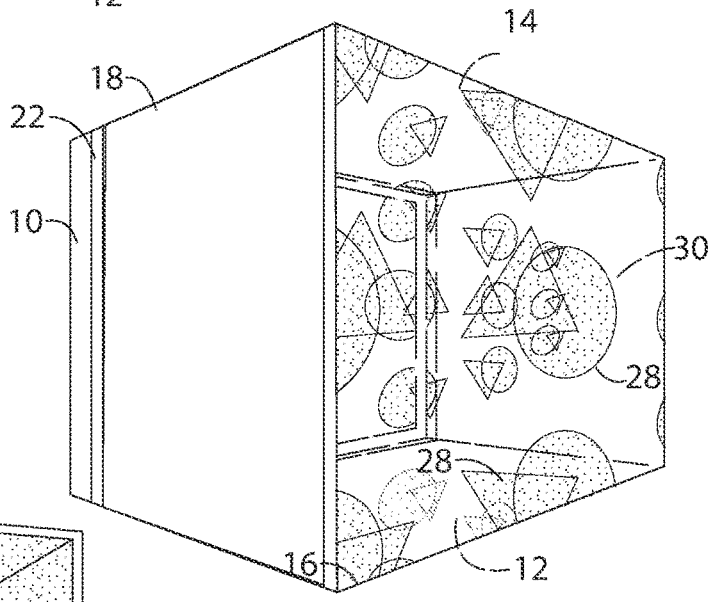
FIG. 7 is a perspective view of an exemplary embodiment of the present invention.

The following detailed description is of the best currently contemplated modes of carrying out exemplary embodiments of the invention. The description is not to be taken in a limiting sense, but is made merely for the purpose of illustrating the general principles of the invention, since the scope of the invention is best defined by the appended claims.

Referring now to the FIGS. 1 through 10, the present invention includes a system of producing visual effects. The system of the present invention includes an enclosure 11. The present invention also embodies a digital video display 10 capable of producing a minimum of 350 nits of brightness and at a contrast ratio of 10,000:1 or greater. The enclosure 11 includes a plurality of sidewalls 13. At least two of the plurality of sidewalls 13 are semi-reflective sidewalls 50. It is understood that the term 'sidewall' may include the top wall (or ceiling) and/or the bottom (or floor) of the enclosure 11.

Figure 11:
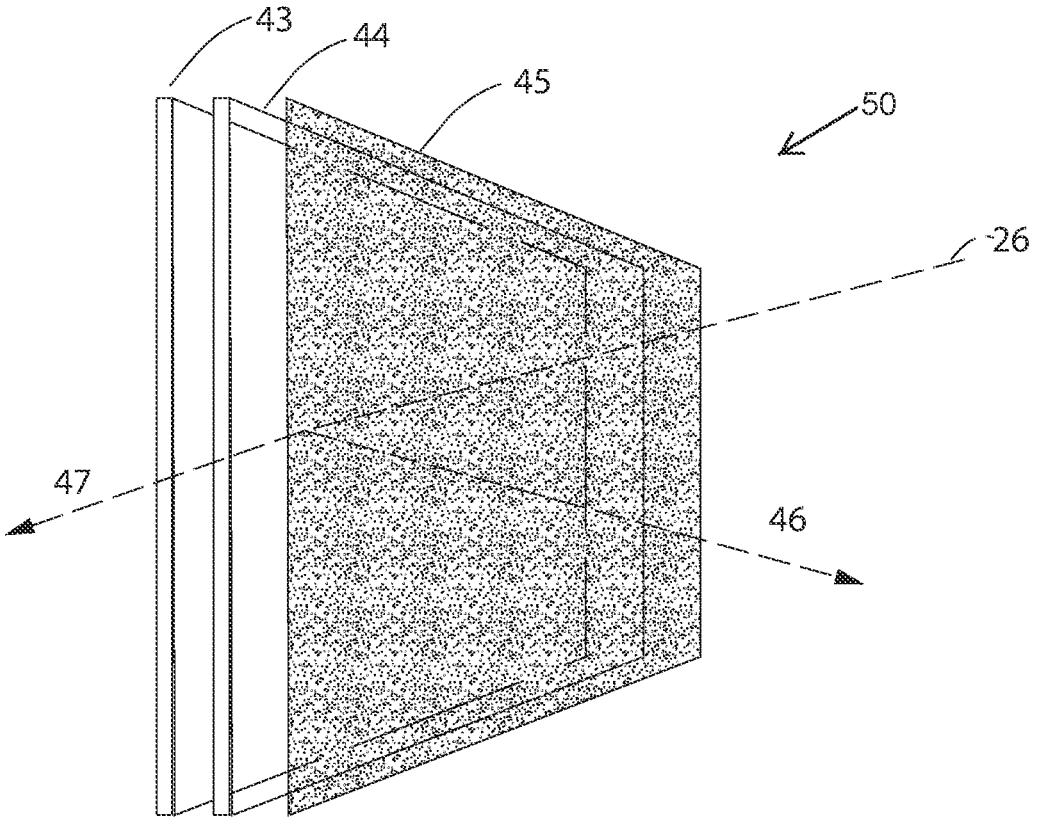
FIG. 11 is an exploded detail perspective view of an exemplary embodiment of the laminated semi-reflective paneling/sidewalls of the present invention, illustrating the separate layers involved and their reflective properties.

The digital video display 10 is positioned to direct digital video imagery through a first semi-reflective sidewall 22 and into the enclosure 11. Light 26 of the digital video imagery contacts the reflective inner surface of least the opposing second semi-reflective sidewall 16, resulting in a reflection 46 of and a transmission 74 through the semi-reflective sidewall, as illustrated in FIG. 11. Thus the definition of semi-reflective sidewall.

In certain embodiments, the plurality of sidewalls 13 includes six sidewalls 13 forming a cuboid shape. The plurality of sidewalls 13 at least include a second semi-reflective sidewall 16 opposite the first semi-reflective sidewall 22, as illustrated in FIG. 1. The plurality of sidewalls 13 may further includes a base 12, a top wall 14, a first side wall 18, and a second sidewall 20 each having either a semi-reflective inner surface or a fully reflective inner surface 30.

As mentioned above, the digital video display 10 is positioned to direct digital video imagery through the first semi-reflective sidewall 22. For example, the digital video display 10 may be directly coupled to the outer surface of the semi-reflective sidewall 22. Alternatively, the digital video display 10 may be separate from the enclosure and facing towards the first semi-reflective sidewall 22. The digital video display 10 may include, but is not limited to Light Emitting Diode displays, projectors, Plasma displays, or other types of video imaging devices capable of producing 350 nits or brighter at a contrast ratio of 10,000:1 or greater.

Figure 8:
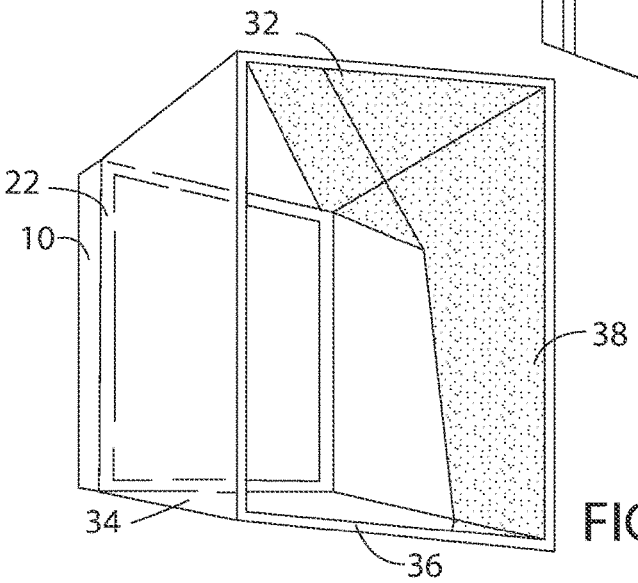
FIG. 8 is a perspective view of an exemplary embodiment of the present invention.
Figure 9:
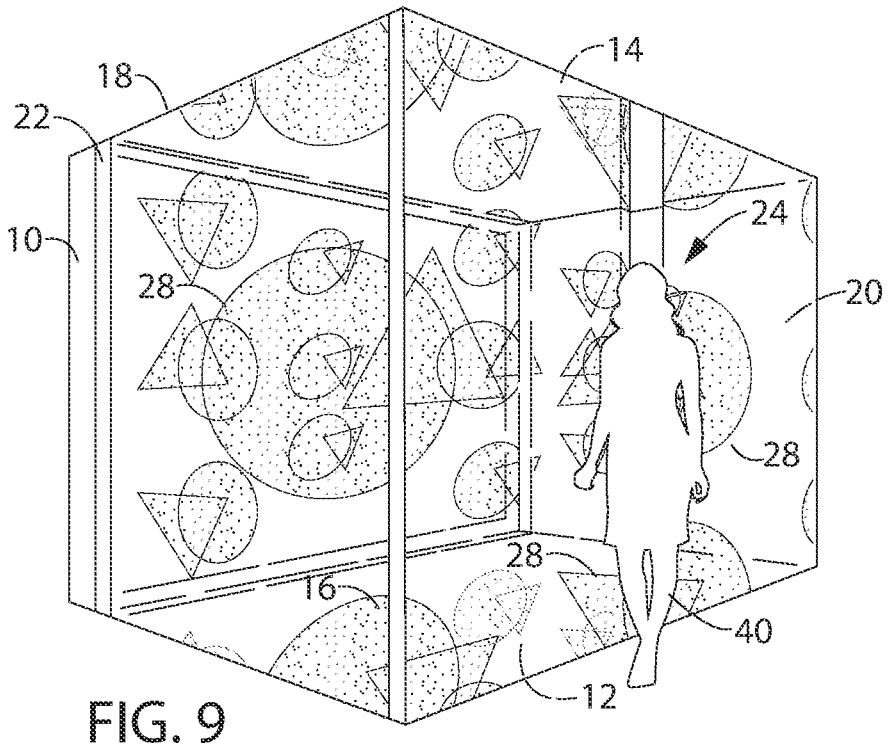
FIG. 9 is a perspective view of an exemplary embodiment of the present invention.

The enclosure 11 of the present invention may include multiple configurations. For example, the enclosure 11 may include an entrance 24, such as an opening in one of the plurality of walls 13, for a user 40 to walk in and view the reflective imagery 28 as well as reflections of themselves 42. As illustrated in FIG. 8, the enclosure 11 may further include an angled ceiling 32, a first angled side wall 34, an angled base 36, and a second angled side wall 38 and therefore may not be a cuboid shape.

Figure 10:
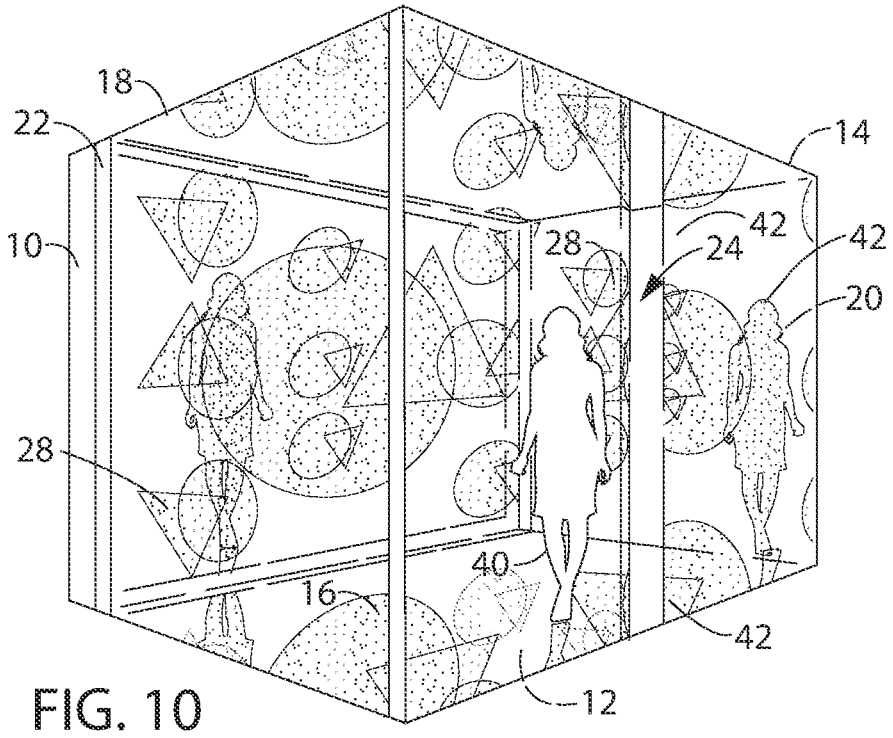
FIG. 10 is a perspective view of an exemplary embodiment of the present invention.

When projecting digital video imagery into the enclosure 11, a hall of mirror effect occurs with reflections layering onto other reflections to create the illusion of depth through repeating content, which also enables an infinity effect via the hall of mirrors. Additionally, with the digital video display 10 on the exterior of the enclosure 11, the digital video display 10 does not interrupt the effect. Therefore, one or more user 40 can view the effect by being inside the enclosure 11 (in large formats), as illustrated in FIG. 10. In this case, the reflections 46 of each interior user 40 contributes to the visual effects via the reflective properties of the inner surface of the semi-reflective sidewalls 50. Additionally, one or more user 42 can view the visual effects outside the enclosure 11 through the second semi-reflective sidewall 16 which acts as a window into the hall of mirrors (again, whose inner reflective surface still contributes to the reflections 46).

The present invention includes a video and semi-reflective mirror configuration that creates unique visual effects. By utilizing the qualities of semi-reflective sidewalls 50, the present invention allows video to be part of the infinity effect: imagery endlessly reflecting and repeating on itself while creating the illusion of vast depth. The video source is placed behind the first semi-reflective sidewall 22 which creates the uninterrupted infinity effect without any unwanted physical obstructions. The qualities of the semi-reflective walls 50 also allow the infinity effect to be observed from outside the enclosure.

The process requires the right relationship between the brightness of the video source, reflectivity of the enclosure surfaces, and strength and smoothness of the enclosure walls. For this reason, it is important to put parameters on each of these related elements.

The video source must emit a brightness of over 350 nits, providing enough light to create the visual effect. The contrast ratio between the video sources brightest points and its darkest points must be a minimum of 10,000:1 for the effect to fully conceal the video source. In certain embodiments, the display 10 should be placed on the exterior of the enclosure, flush against a semi-reflective wall. This will conceal the hardware from the viewer and only allow its light to transmit through the semi-reflective sidewall 13/22 and into the enclosure 11.

The semi-reflective surface may be defined as any transparent substrate with a coating that produces a reflection rate of 30-70% and a transmission rate between 70-30%. Referring to FIG. 11, the original path of light from the video display 26 becomes split when hitting the semi-reflective surface 45. The resulting light is a reflection 46 of 30-70% of the original light source, and a transmission 47 of the original light source. This cycle of reflection 46 and transmission 47 repeatedly splits the light from the video display in a ratio that is favorable to the interior of the enclosure, making it observable from both inside and outside the enclosure.

Semi-reflective walls can be described through a ratio of transmission rate and reflection rate. Transmission rate refers to the percentage of light that passes through the substrate, while reflection references the light that reflects off the surface. This combined number must be below 100.

The reflection and transmission rates are critical for the visual effect to be created. It should be stated that the reflection and transmission rate are related numbers—and any grade of semi-reflective coating will have a transmission and reflection rate whose sums of the two numbers is slightly less than 100%. If the semi-reflective coating has a reflection rate below 30%, each subsequent reflection becomes diminished to an extent that the sense of depth is lost, and the infinity effect fails. A transmission rate above 70% will cause too ambient light from the external environment to enter the interior of the enclosure, causing the immersive effect to fail. If the semi-reflective coating has a transmission rate of below 30%, then not enough light is transmitted through the surface, causing the external viewing experience to fail. A transmission rate of below 30% also impairs the video source from providing sufficient light to create an effective infinity experience.

In certain embodiments of the present invention, semi-reflective walls refer to a range between 35%-65% reflection rate and 65%-35% transmission rate—to create the appropriate lighting contrast between the invention and its environment. The function of this is to simultaneously conceal video display's hardware and to create a desired contrast between the light generated by the present invention and the environment it sits it.

In some embodiments, applying a semi-reflective coating to a tinted substrate can reduce transmission rates to a semi-reflective wall while retaining its reflection rate. As in all cases, the semi-reflective surface will face the interior of the enclosure.

Fully reflective surfaces 30 speak to traditional mirrors or highly polished metals. They can be defined as any surface with a minimal reflection rate of 95% and a maximum transmission rate of 0.1%. In the embodiments that they are employed, the fully reflective surfaces face the interior of the enclosure. Exterior surface or substrate has no consequence to the effect.

The second critical feature in the construction of the enclosure 11 is to maintain reflection quality while achieving structural strength and integrity, including the integrity of the reflective surfaces. Traditional tempering and heat strengthening techniques cause substrates to distort—creating waves in the reflections. Referring to FIG. 11, each semi-reflective sidewall 50 may be a laminate. The system embodied by the present invention avoids distortion by laminating tempered glass 43 with un-tempered substrate 44. The untampered substrate 44 provides a smooth surface for semi-reflective coating 45 to produce reflections without distortion. The tempered glass 43 provides strength of at least 10,000 psi. The semi-reflective coating will be the surface facing the interior of the enclosure 11, while the tempered layer faces the exterior.

A method of making the present invention may include the following. Create an enclosed or semi-enclosed shape with reflective surfaces facing inward. This shape can be fabricated any number of ways, using glass or plastic substrates, as disclosed above. At least two surfaces are semi-reflective, while typically all of the sidewalls are semi-reflective or fully reflective. Any standard video technology producing greater than 350 nits with a contrast ratio of 10,000:1 may work. The video screen is placed near the exterior surface of a semi-reflective side of the mirrored enclosure 11.

The geometry of the enclosure 11 creates different effects. By displaying video content using this technique, the present invention creates a visual effect that is compelling to look at from the inside or the outside. The present invention may be utilized for: promotional reasons; home décor; artistic expression; in-camera video effects; and the like. The present invention may be used to create pop-up marketing installations, artistic use, store displays, photo booths, windows, trippy home decoration, and more.

It should be understood, of course, that the foregoing relates to exemplary embodiments of the invention and that modifications may be made without departing from the spirit and scope of the invention as set forth in the following claims.

What is claimed is:

1. An enclosure for producing visual effects observable from outside and inside of the enclosure, wherein the enclosure is configured to accommodate at least one human being therein, the enclosure comprising: a plurality of sidewalls each comprising a reflective inner surface facing one other, wherein at least one of the plurality of sidewalls is a first semi-reflective sidewall; and a second semi-reflective sidewall opposite the first semi-reflective sidewall; each semi-reflective sidewall comprises a tempered glass and an un-tempered substrate laminated to the tempered glass, wherein the un-tempered substrate is smooth and has a coating providing a reflection rate between 30 and 70 percent and a transmission rate between 70 and 30 percent, wherein the un-tempered is the reflective inner surface, wherein the inner surfaces of the plurality of sidewalls other than the first semi-reflective sidewall and the second semi-reflective sidewall is one of fully reflective and semi-reflective; and a digital video display positioned to direct digital video imagery through the first semi-reflective sidewall and into the enclosure, wherein light of the digital video imagery reflects off the reflective inner surfaces of the plurality of sidewalls, wherein the digital video imagery comprises a minimum of 350 nits of brightness at a contrast ratio of 10,000:1 or greater.

2. The system of claim 1, wherein the plurality of sidewalls comprises six sidewalls forming a cuboid shape.

3. The system of claim 1, wherein the inner surfaces of the plurality of sidewalls other than the first semi-reflective sidewall and the second semi-reflective sidewall is one of fully reflective and semi-reflective.

4. The system of claim 1, wherein the digital video display is coupled to the tempered glass of the first semi-reflective sidewall.

5. The system of claim 1, wherein the enclosure further comprises an entrance.

6. The system of claim 1, wherein the enclosure includes an angled ceiling.

* * * * *